United States Patent [19]

Williams

[11] Patent Number: 4,485,938

[45] Date of Patent: Dec. 4, 1984

[54] TAMPERPROOF PILL DISPENSING APPARATUS

[76] Inventor: Marvin D. Williams, 37 Sherman La., Greenville, S.C. 29605

[21] Appl. No.: 476,921

[22] Filed: Mar. 21, 1983

[51] Int. Cl.[3] ..... A47F 1/10

[52] U.S. Cl. ..... 221/154

[58] Field of Search ..... 222/153; 221/154, 264, 221/265; 215/205, 201; 206/1.5

[56] References Cited

U.S. PATENT DOCUMENTS 2,653,850 9/1953 Vollten ..... 221/264 X

*Primary Examiner*—Stanley H. Tollberg

*Attorney, Agent, or Firm*—Cort Flint

[57] ABSTRACT

A tamperproof pill dispenser is disclosed which includes a housing (10) having a pill discharge outlet in the form of a cone (16). Above the discharge outlet is carried a dispensing plate (20) and a rotating dispensing wheel (24) having tablet openings (22, 26) formed therein. A dispensing latch (32) is slidably carried by the dispensing plate (20) and includes a second dispensing opening (34) which registers with the openings (26, 22) when moved to a dispense position in order to dispense a tablet from the reservoir (12) through the discharge outlet (16). A safety latch pin (50) engages a latch opening (58) in the dispensing latch (32) and includes a manual handle (54) disposed remotely from a finger tab (36) of the dispensing latch so as to disassociate simultaneous operation of the two. Diametrically opposed safety latches (82, 80) lock a threaded closure (14) in place on top of the housing. Simultaneous depression of safety latches (82, 80) and unthreading of the closure (14) are required in order to have access to the pill reservoir (12). Spacing of the safety latches (82, 80) impedes their operation by the hand of a small child or infant. An indexing groove (30) and follower pin (38) index the dispensing wheel (24) to bring a single tablet opening (26) through registration with the dispensing opening (22).

15 Claims, 4 Drawing Figures

TAMPERPROOF PILL DISPENSING APPARATUS

BACKGROUND OF THE INVENTION

The invention relates to a pill dispenser for dispensing medicine and health tablets or capsules with features that impede the dispensing of the tablet from the apparatus by an infant or a young child.

With the increasing use of vitamins and medicinal tablets due to the emphasis on improving health and body condition, there is a need to have a dispenser for domestic use which may be readily and conveniently operated yet which cannot be operated or tampered with by infants or young children.

Heretofore, various pill dispensing devices have been proposed such as in U.S. Pat. Nos. 2,227,167 and 3,885,703. These devices generally include a dispensing outlet through which a single tablet may be dispensed and a rotatable dispensing plate which carries the tablet around to the dispensing opening. However, these devices are not entirely safe or suitable for domestic use where small children may be present.

SUMMARY OF THE INVENTION

Accordingly, an important object of the present invention is to provide a dispenser for dispensing tablets, pills, and capsules of the medicinal or health type which is virtually tamperproof and inoperable by small children and infants.

Still another important object of the present invention is to provide a pill dispenser which includes safety features which prevents a lid closure from being removed by a small child or an infant as well as including a safety feature which prevents a pill dispensing latch from being operated.

Still another important object of the present invention is to provide a dispensing apparatus having improved construction which provides a simplified and reliable pill dispenser.

The above objectives are accomplished according to the present invention by providing a dispenser housing having a reservoir for containing pills in the form of tablets or capsules. The reservoir is closed by means of a lid closure on one end and includes a discharge outlet on the opposing end. A dispensing plate is carried across the discharge outlet having a dispensing opening therein. There is a rotatable dispensing wheel carried above the dispensing plate which has a plurality of tablet openings. A slidable dispensing latch is carried by the dispensing plate. A second dispensing opening in the dispensing latch is aligned with the first dispensing opening in the dispensing plate and one of the tablet openings in the dispensing wheel when moved to a dispense position in which a pill is dispensed through the aligned openings. The sliding reciprocal motion of the dispensing latch is translated into a rotary motion imparted to the dispensing wheel by means of a follower pin and groove arrangement such that a simplified and reliable dispensing of tablets is provided. A safety latch pin engages the dispensing latch and prevents its operation. The safety latch pin includes a handle element which need be manually operated in order to operate the dispensing latch. The handle element of the safety latch pin is removed and located with respect to the dispensing latch so as to not be associated with its operation. Thus, it is unlikely that an infant or small child would simultaneously operate the safety latch and dispensing latch as required. The lid closure is provided with two safety latches which must be simultaneously operated but which are located around the periphery of the lid closure to such an extent that they will be out of reach of a small child's hand as required to operate the two latches simultaneously.

Accordingly, the above apparatus has been found to provide a simple and convenient pill dispensing apparatus for domestic use which may be used by a person taking a regular dosage of medicinal or health tablets without the fear of use by small children.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
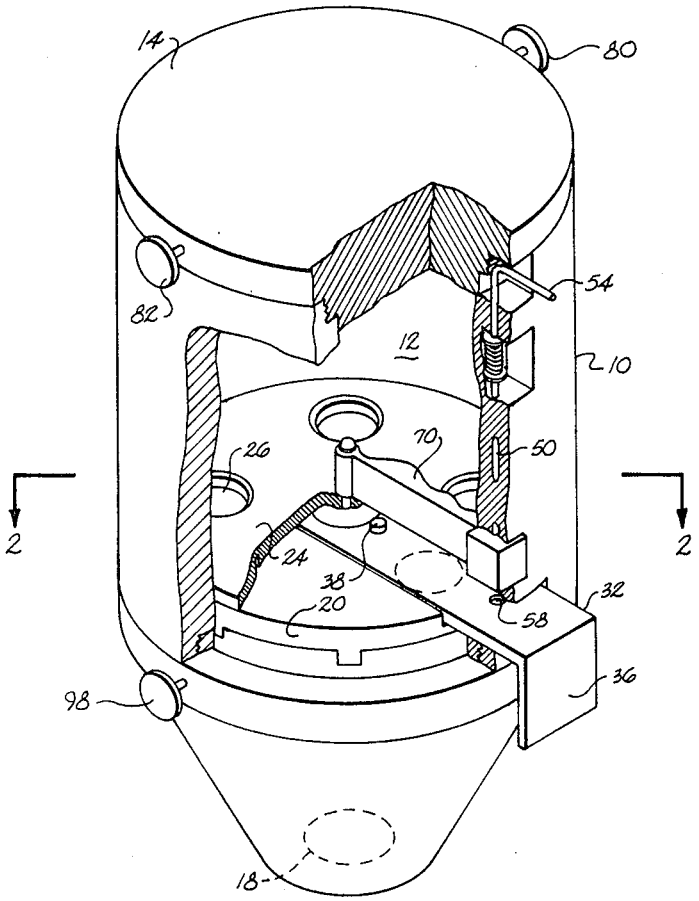
FIG. 1 is a perspective view with parts cut away illustrating a tamperproof pill dispensing apparatus constructed according to the present invention.

The drawings illustrate a dispensing apparatus for dispensing medicinal and health pills in the form of tablets, capsules and the like.

As illustrated, the apparatus includes a dispenser housing 10 having a reservoir 12 for containing pills. The housing has an open end which is closed by a lid closure 14 and a discharge end which is illustrated in the form of a dispensing cone 16 having a discharge outlet 18. A stationary dispensing plate 20 is carried across the discharge end of the housing and includes a first dispensing opening 22 for dispensing a tablet into the discharge cone and outlet 18.

There is a rotatable dispensing wheel 24 carried above the dispensing plate 22 having a plurality of tablet openings 26 carried therein. The tablet openings are spaced circumferentially around the dispensing wheel such that they may be brought into individual alignment with the first dispensing opening 22 such that a tablet contained in the opening 26 drops through the opening. An indexing means is provided for turning the wheel 24 in the form of an indexing groove 30 formed in the bottom of the wheel 24 facing the plate 20 and a follower pin arrangement to be described hereinafter.

A dispensing latch 32 is slidably carried by the dispensing plate 20. A second dispensing opening 34 is formed in the dispensing latch. When the dispensing latch is moved to a dispense position by pulling the finger tab 36 away from the dispenser to a fully extended position, the first and second dispensing openings 22 and 34 are in dispensing alignment with one another. In addition, a tablet opening 26 is also brought into alignment with the first and second dispensing openings on movement of the dispensing latch to the dispense position.

Figure 2:
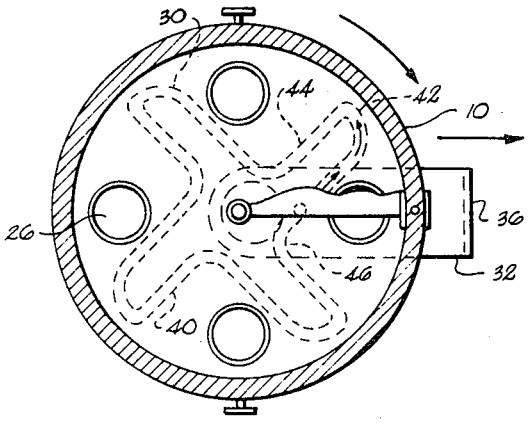
FIG. 2 is a sectional view taken along line 2—2 of FIG. 1.

Complementary means for indexing the dispensing wheel such that a tablet opening is in alignment with the dispensing openings is provided in the form of a follower pin 38 carried on the dispensing latch which rides in the groove 30. As can best be seen in FIG. 2, the groove 30 includes a camming portion 40 in which the pin rides to rotate the wheel as the dispensing latch is pulled away from the dispenser. With the pin at the end 42 of the camming portion, the openings will be in alignment with each other such that a tablet in a tablet opening 26 falls through the aligned openings 22, 34 and through the discharge outlet 18. Upon pushing and reciprocating the dispensing latch back to its normal position, the pin 38 will travel in a straight portion 44 of the groove whereupon it will not move the wheel but the pin will return to a starting position at 46. The dispensing latch is then ready to index the wheel to another tablet opening upon extending the latch to the dispense position. The dispensing latch 36 slides in a groove 48 formed in the dispensing plate 20 such that the dispensing latch is flush with the dispensing plate for unobstructed travel of the dispensing wheel thereover.

Figure 3:
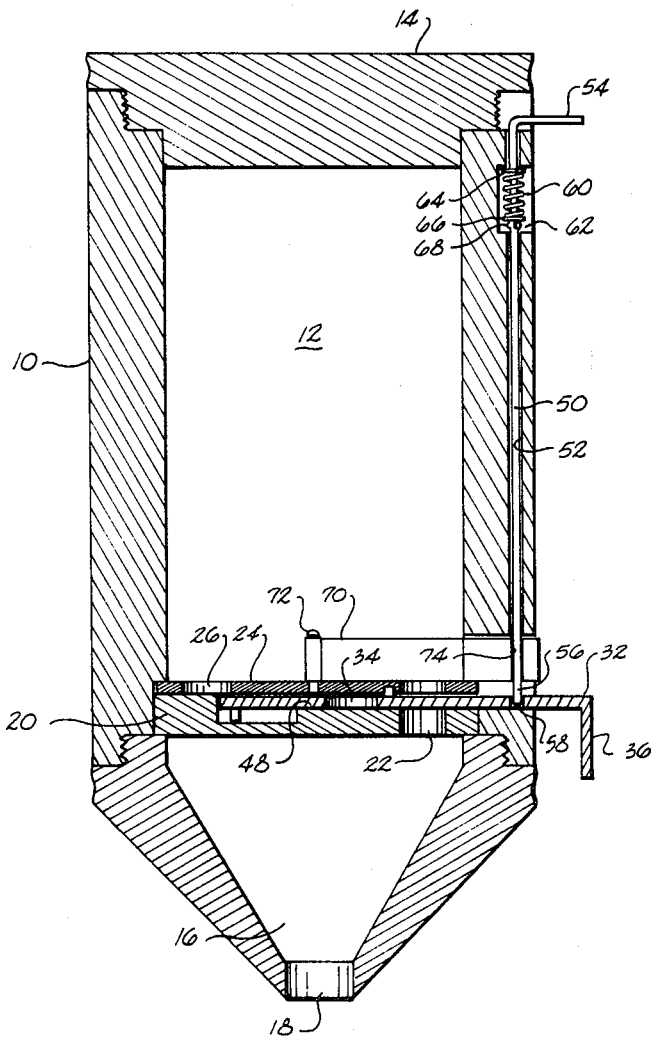
FIG. 3 is a sectional view taken along line 3—3 of FIG. 1.
Figure 4:
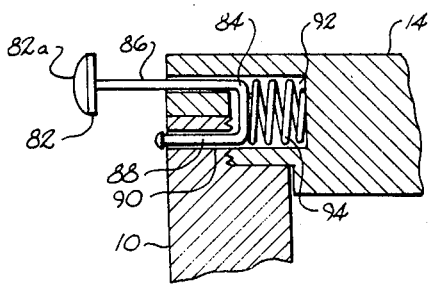
FIG. 4 is a partial sectional view of a lid closure safety latch constructed according to the present invention.

There is a first safety means for preventing operation of the dispenser illustrated in the form of an elongated safety latch pin 50. The elongated safety pin 50 is received in a vertical shaft 52 formed in the dispenser housing. There is a thumb lift 54 on the end of the safety pin which provides a manually movable handle element for actuating the safety pin. An engagement end 56 of the safety pin is received in a complementary lock opening 58 formed in dispensing latch 32. A biasing spring 64 carried in a recess 62 in the dispenser housing urges the pin 50 downwardly into the engagement lock opening 58. Thus, the thumb lock 54 must be raised in order for the dispensing latch 36 to be pulled outwardly by the finger tab 36. The engagement end 56 will ride on the top surface of the dispensing latch. When the dispensing latch is returned from its dispense position to its normal position, as can best be seen in FIG. 3, the safety pin 50 automatically engages into the opening 58 to lock the dispensing latch.

Spring 60 is carried between a pair of washers 64, 66 with washer 66 being carried above a tab portion 68 on the safety pin which retains the same in position.

A baffle 70 is carried across the diameter of the reservoir 12 so as to partition and divide off the tablets reliably into a tablet opening 26 as the dispensing wheel 24 rotates. One end of the baffle includes an opening in which a pivot pin 72 is carried which provides an axis about which the wheel 24 rotates. The opposing end of the baffle is secured in the housing and includes an opening 74 in which the safety pin 50 is slidably received. Thus the baffle not only serves to partition off pills into the tablet openings but as a pivot for the wheel to turn.

Second safety means for securing the lid closure 14 against tampering and removal by young children is provided in the form of a first and second manually operated safety latch members 80 and 82 carried diametrically opposed on the top of the lid. By so spacing the manually operable members with respect to each other, the span of the hand of a small child is inadequate to reach and actuate both of the members simultaneously as required to remove the lid closure 14. Thus, removal of the tablets from the interior of the dispenser housing is effectively prevented.

Furthermore, the lid closure 14 is threadably mated with the open end of the reservoir of the dispenser housing. This requires that the safety members 80 and 82 be depressed during the entire unthreading of the lid closure which would be virtually impossible by a young child. If the lid were unthreaded, there would be an increased possibility that a small child or infant could press both members 82 and 80 and remove the lid as opposed to the procedure whereby the members must be depressed continuously while the lid is unthreaded. Thus, in this case, the threads and the safety members operate together to make the dispenser more tamperproof.

The first and second manually operable members 82 and 80 are illustrated in the form of a safety latch having a generally U-shaped shank 84 having a first leg 86 which button **82*a* is carried and another shank leg 88 which is free and which is received in a latch opening 90 formed in the housing. Second safety latch 80 is identically constructed. There is a latch recess 92 for each latch 82 and 80 formed in the lid closure 14. There is a biasing spring 94 carried in each recess 92 which urges the latch 82, 80 outwardly such that the shank 88 engages in the latch opening 90 formed in the reservoir housing wall. Thus, the button 82 must be depressed against the spring 94 in order to rotate and unthread lid closure 14**.

The bottom discharge cone 16 is also threadably attached to cylinder 10 and secured by identical safety latches 82, 80 at the bottom thereof to prevent access to the interior of the dispensing apparatus.

Thus, it can be seen that an advantageous form and construction of a tamperproof pill dispenser can be had according to the present invention which impedes the operation of the apparatus by a small child or infant to the point where the risk is substantially reduced or eliminated. The operation of the device is effectively impeded as is the removal of the contents of the dispensing apparatus. In addition, a most simplified and reliable means of dispensing the tablets and indexing operation is provided.

While a preferred embodiment of the invention has been described using specific terms, such description is for illustrative purposes only, and it is to be understood that changes and variations may be made without departing from the spirit or scope of the following claims.

What is claimed is:

1. Tamperproof apparatus for the dispensing of medicinal and health tablets and the like having an operation which is impeded by an infant or young child comprising:

a housing having a reservoir for containing said tablets having an open end and a discharge end;

a lid closure for closing said open end of said housing;

said discharge end of said housing including a discharge outlet;

a stationary dispensing plate carried by said housing across said discharge outlet;

said dispensing plate having a first dispensing opening formed therein for dispensing of a tablet into said discharge outlet;

a rotatable dispensing wheel carried above said dispensing plate having a plurality of tablet openings formed therein which are circumferentially spaced around a periphery of said dispensing wheel to be in individual alignment with said first dispensing opening of said dispensing plate as said dispensing wheel is rotated;

an indexing groove formed in a bottom of said dispensing wheel facing said dispensing plate;

a dispensing latch slidably carried by said dispensing plate;

a second dispensing opening formed in said dispensing latch which is brought into alignment with said first dispensing opening and said tablet opening when said dispensing latch is moved to a dispense position for dispensing a tablet;

guide means carried by said dispensing plate for guiding said dispensing latch in reciprocal linear motion;

a follower pin carried by said dispensing latch received in said indexing groove of said dispensing wheel;

said follower pin and indexing groove rotating and indexing said dispensing wheel in response to movement of said dispensing latch so that one of said tablet openings is in said alignment with said first dispensing opening upon full extension of said dispensing latch to said dispense position wherein it is fully distended in a straight line motion away from said housing;

said tablet opening, said second dispensing opening, said first dispensing opening, and said discharge outlet being aligned with one another so that a tablet carried in said tablet opening passes from said reservoir through said aligned openings and outwardly through said discharge outlet when said dispensing latch is moved to said dispense position;

said dispensing latch having a normal position in which said follower pin is disposed in said groove at a start position of said indexing groove; movement of said dispensing latch from said dispense position to said normal position causing said dispensing wheel to remain substantially idle in said aligned position;

first safety means locking said dispensing latch in said normal position preventing movement of said dispensing latch to said dispense position;

manual means for releasing said safety means when actuated;

said safety means including automatic engagement means for automatically locking said dispensing latch in said normal position upon return of said dispensing latch to said normal position following dispensing of a tablet; and said safety means permitting operation of said dispensing latch and movement to said dispense position only upon actuation of said manual means simultaneously with operation of said dispensing latch.

2. The apparatus of claim 1 wherein said safety means includes a spring loaded elongated pin means carried by said housing, complementary pin locking means carried by said dispensing latch for automatically engaging with an engagement end of said spring loaded pin means upon return of said dispensing latch to said normal position.

3. The apparatus of claim 2 wherein said safety pin means includes a manually operable handle element providing said manual means, said safety pin means including an elongated pin shaft, said handle element being carried adjacent an end of said shaft remote from said engagement end, said handle element being spaced sufficiently away from said dispensing latch by the length of said shaft so that said dispensing latch operation and manual safety handle operation are disassociated from one another to an extent that simultaneous operation by an infant or small child would not be likely.

4. The apparatus of claim 1 wherein said lid closure includes a second safety means carried atop said housing which must be manually operated in order to remove said lid closure from said housing, said second safety means including first and second manually operable members which must be simultaneously actuated in order to remove said lid closure, said first and second manually operable members being spaced from one another about a periphery of said lid closure such that the span of the hand of a small child is inadequate to reach and actuate both of said members simultaneously.

5. The apparatus of claim 1 including a baffle means extending across a partial width of said reservoir adjacent said tablet opening and second dispensing opening for engaging tablets causing same to enter into said tablet openings in a reliable manner.

6. The apparatus of claim 5 wherein said baffle means includes an opening on one end which receives a pivot pin about which said dispensing wheel rotates and an opposing end of said baffle includes an opening through which said safety pin means slides to engage said dispensing latch.

7. The apparatus of claim 1 wherein said dispensing latch includes an elongated plate member having parallel sides, said guide means including a correspondingly shaped recess formed in said dispensing plate in which said dispensing latch slides, said dispensing latch being generally flush with said dispensing plate such that said dispensing wheel rotates unobstructedly thereover.

8. The apparatus of claim 1 wherein said lid closure is threadably mated with said dispenser housing and said apparatus includes:

a first recess formed in said lid closure;

a second recess formed in said lid closure spaced around the periphery of said lid closure;

a biasing spring carried in each said recess;

a first manually operable safety latch carried in said first recess having a generally U-shaped shank;

a second manually operable safety latch carried in said second recess having a generally U-shaped shank;

a first latch opening formed in said housing;

a second latch opening formed in said housing;

said first and second latch openings being in alignment with said first and second safety latches with said lid closure threaded in place;

a free leg of said U-shaped shank of said first and second safety latches being urged into respective ones of said first and second safety latch openings with said lid closure in place;

said first and second safety latches being movable against said biasing spring to an extent that said free leg is removed from each said latch opening whereby said lid closure may be rotated and unthreaded for removal; and said first and second safety latch recesses being spaced around the periphery of said lid closure sufficiently to an extent that simultaneous actuation of said first and second safety latches by a young child is unlikely.

9. Tamperproof apparatus for the dispensing of medicinal and health tablets and the like having an operation which is impeded by an infant or young child comprising:

a housing having a reservoir for containing said tablets having an open end and a discharge end;

a lid closure for closing said open end of said housing;
said discharge end of said housing including a discharge outlet;
a stationary dispensing plate carried by said housing across said discharge outlet;
said dispensing plate having a first dispensing opening formed therein for dispensing of a tablet into said discharge outlet;
a rotatable dispensing wheel carried above said dispensing plate having a plurality of tablet openings formed therein which are circumferentially spaced around a periphery of said dispensing wheel to be in individual alignment with said first dispensing opening of said dispensing plate as said dispensing wheel is rotated;
an indexing groove formed in a bottom of said dispensing wheel facing said dispensing plate;
a dispensing latch slidably carried by said dispensing plate;
a second dispensing opening formed in said dispensing latch which is brought into alignment with said first dispensing opening and said tablet opening when said dispensing latch is moved to a dispense position for dispensing a tablet;
guide means carried by said dispensing plate for guiding said dispensing latch in reciprocal linear motion;
a follower pin carried by said dispensing latch received in said indexing groove of said dispensing wheel;
said follower pin and indexing groove rotating and indexing said dispensing wheel in response to movement of said dispensing latch so that one of said tablet openings is in said alignment with said first dispensing opening upon full extension of said dispensing latch to said dispense position wherein it is fully distended in a straight line motion away from said housing;
said tablet opening, said second dispensing opening, said first dispensing opening, and said discharge outlet being aligned with one another so that a table carried in said tablet opening passes from said reservoir through said aligned openings and outwardly through said discharge outlet when said dispensing latch is moved to said dispense position;
said dispensing latch having a normal position in which said follower pin is disposed in said groove at a start position of said indexing groove; movement of said dispensing latch from said dispense position to said normal position causing said dispensing wheel to remain substantially idle in said aligned position;
first safety means locking said dispensing latch in said normal position preventing movement of said dispensing latch to said dispense position;
said safety means including a spring loaded elongated pin means carried by said housing, complementary pin locking means carried by said dispensing latch for automatically engaging with an engagement end of said spring loaded pin means upon return of said dispensing latch to said normal position;
said safety pin means including an elongated pin shaft, a manually operable handle element for releasing said safety pin means carried adjacent an end of said shaft remote from said engagement end, said handle element being spaced sufficiently away from said dispensing latch by the length of said shaft so that said dispensing latch operation and manual safety handle operation are disassociated from one another to an extent that simultaneous operation by an infant or small child would not be likely;
said first safety means permitting operation of said dispensing latch and movement to said dispense position only upon actuation of said manual handle element simultaneously with operation of said dispensing latch.

10. The apparatus of claim 9 wherein said lid closure is threadably mated with said housing and includes a second safety means carried atop said housing which must be manually operated in order to remove said lid closure from said housing, said second safety means including first and second manually operable members which must be simultaneously actuated in order to remove said lid closure, said first and second manually operable members being spaced from one another about a periphery of said lid closure such that the span of the hand of a small child is inadequate to reach and actuate both of said members simultaneously.

11. Tamperproof apparatus for the dispensing of medicinal and health tablets and the like having an operation which is impeded by an infant or young child comprising:
a housing having a reservoir for containing said tablets having an open end and a discarge end;
a lid closure for closing said open end of said housing;
said discharge end of said housing including a discharge outlet;
a stationary dispensing plate carried by said housing across said discharge outlet;
said dispensing plate having a first dispensing opening formed therein for dispensing of a tablet into said discharge outlet;
a rotatable dispensing wheel carried above said dispensing plate having a plurality of tablet openings formed therein which are circumferentially spaced around a periphery of said dispensing wheel to be in individual alignment with said first dispensing opening of said dispensing plate as said dispensing wheel is rotated;
an indexing means carried by said dispensing wheel;
a dispensing latch slidably carried by said dispensing plate;
a second dispensing opening formed in said dispensing latch which is brought into alignment with said first dispensing opening and said tblet opening when said dispensing latch is moved to a dispense position for dispensing a tablet;
a complementary indexing means carried by said dispensing latch engaging with said indexing means of said dispensing wheel;
said complementary indexing means and indexing means rotating and indexing said dispensing wheel in response to movement of said dispensing latch so that one of said tablet openings is in said alignment with said first dispensing opening upon movement of said dispensing latch to said dispense position;
said tablet opening, said second dispensing opening, said first dispensing opening, and said discharge outlet being aligned with one another so that a tablet carried in said tablet opening passes from said reservoir through said aligned openings and outwardly through said discharge outlet when said dispensing latch is moved to said dispense position;

first safety means locking said dispensing latch in said normal position preventing movement of said dispensing latch to said dispense position;

manual means for releasing said safety means when actuated carried sufficiently remote from said dispensing latch to disassociate simultaneous accidental operation by small children and infants;

said safety means including automatic engagement means for automatically locking said dispensing latch to said normal position following dispensing of a tablet; and second safety means impeding removal of said lid closure.

12. The apparatus of claim 11 wherein said safety means includes a spring loaded elongated pin means carried by said housing, complementary pin locking means carried by said dispensing latch for automatically engaging with an engagement end of said spring loaded pin means upon return of said dispensing latch to said normal position.

13. The apparatus of claim 12 wherein said safety pin means includes a manually operable handle element providing said manual means, said safety pin means including an elongated pin shaft, said handle element being carried adjacent an end of said shaft remote from said engagement end, said handle element being spaced sufficiently away from said dispensing latch by the length of said shaft so that said dispensing latch operation and manual safety handle operation are disassocaited from one another to an extent that simultaneous operation by an infant or small child would not be likely.

14. The apparatus of claim 11 wherein said lid closure is threadably mated with said housing and said second safety means includes first and second manually operable members which must be simultaneously actuated in order to rotate and unthread said lid closure, said first and second manually operable members being spaced from one another about a periphery of said lid closure such that the span of the hand of a small child is inadequate to reach and actuate both of said members simultaneously.

15. The apparatus of claim 11 wherein said lid closure is threadably mated with said dispenser housing and said apparatus includes:

a first recess formed in said lid closure;

a second recess formed in said lid closure spaced around the periphery of said lid closure;

a biasing spring carried in each said recess;

a first manually operable safety latch carried in said first recess having a generally U-shaped shank;

a second manually operable safety latch carried in said second recess having a generally U-shaped shank;

a first latch opening formed in said housing;

a second latch opening formed in said housing;

said first and second latch openings being in alignment with said first and second safety latches with said lid closure threaded in place;

a free leg of said U-shaped shank of said first and second safety latches being urged into respective ones of said first and second safety latch openings with said lid closure in place;

said first and second safety latches being movable against said biasing spring to an extent that said free leg is removed from each said latch opening whereby said lid closure may be rotated and unthreaded for removal; and said first and second safety latch recesses being spaced around the periphery of said lid closure sufficiently to an extent that simultaneous actuation of said first and second safety latches by a young child is unlikely.

* * * * *